United States Patent [19]

Chininis

[11] Patent Number: 4,717,145

[45] Date of Patent: Jan. 5, 1988

[54] KAYAK EXERCISER DEVICE

[75] Inventor: Steve P. Chininis, Opelika, Ala.

[73] Assignee: Diversified Products Corp., Opelika, Ala.

[21] Appl. No.: 819,014

[22] Filed: Jan. 15, 1986

[51] Int. Cl.[4] ..... A63B 69/06

[52] U.S. Cl. ..... 272/72; 272/130

[58] Field of Search ..... 272/72, 130, 143, 144, 272/140, 141, 132, 131; 128/25 R

[56] References Cited

U.S. PATENT DOCUMENTS

| | | | |
|---|---|---|---|
| 1,707,791 | 4/1929 | Anderson | 272/134 X |
| 3,792,860 | 2/1974 | Selnes | 272/58 |
| 4,402,505 | 9/1983 | Young | 272/130 |
| 4,429,871 | 2/1984 | Flechner | 272/130 |

FOREIGN PATENT DOCUMENTS

| | | | |
|---|---|---|---|
| 1097873 | 1/1961 | Fed. Rep. of Germany | 272/72 |
| 150850 | 9/1981 | German Democratic Rep. | 272/72 |
| 0218733 | 2/1985 | German Democratic Rep. | 272/72 |
| 0935117 | 6/1982 | U.S.S.R. | 272/72 |
| 1044299 | 9/1983 | U.S.S.R. | 272/72 |

*Primary Examiner*—Richard J. Apley
*Assistant Examiner*—Howard Flaxman
*Attorney, Agent, or Firm*—Banner, Birch, McKie & Beckett

[57] ABSTRACT

An exercise device which similates the rowing motion of a kayack or similar single oar craft. A pivot rod and resistance cylinders are fixed between a support frame and an oar. A coupling bracket on the oar allows the position at which the cylinders are attached to the oar to be varied, thus varying the exercise resistance. A mounting arm allows the exercise device to be fixed to a base member.

3 Claims, 3 Drawing Figures

KAYAK EXERCISER DEVICE

BACKGROUND OF THE INVENTION

This invention relates to physical exercising apparatus and, more particularly, to a rowing-type exersise apparatus which simulates rowing using a double bladed oar.

Various types of rowing type exercisers are well known. However, most of these exercise rowers simulate the motion of rowing a scull or row boat in which two oars are used. Various prior art devices have used complex and unwieldy mechanisms to try and simulate the motion of rowing a kayak or other craft in which a double bladed oar is used. However, none of these prior known devices provide a compact, variable resistance, single oar rowing device which may be used alone or in conjunction with other home exercise equipment.

SUMMARY OF THE INVENTION

The present invention comprises an exercising device for performing rowing type exercises. The invention includes a support member, or frame, and a user-engageable handle, or oar. The oar is spaced from the support member. A pivot rod is fixed to the support member and the other end of the pivot rod is fixed to the oar. Preferably, the exercise device of the present invention further includes a guide tube. The pivot rod of the present invention passes through the guide tube and is longitudinally slidable within the guide tube.

Resistance means, preferably comprising fluid resistance cylinders of the type commonly used on home exercise devices, are positioned on either side of the pivot rod and are fixed to the support member and the oar.

In a preferred form of the invention, the exercise device is adapted to be fixed to a home exercise device, such as a conventional rowing machine. Thus, the invention expands the capabilities and exercises available on a conventional home exercise machine. The invention includes a mounting assembly for mounting the exercise device to a base member of, for example, a home rowing machine. In order to facilitate mounting and properly positioning the invention to a conventional home rowing-type exercise device, the invention further includes a mounting arm fixed at one end to the guide tube and adapted to be fixed at the other end of the mounting arm to a base member. In a preferred form of the invention, the mounting arm is formed with the exercise device angled upwardly as it faces the user so that the simulated motion will be more realistic.

The invention further includes adjustable coupling means for fixing the resistance cylinders to the oar so that the exercise resistance of the exercise device may be varied. In a preferred form of the invention, the coupling means comprises a coupling bracket fixed to the oar. The coupling bracket includes coupling openings for attaching each of the resistance cylinders to one of a plurality of longitudinally spaced positions on the coupling bracket.

Although the preferred embodiment described herein shows the invention mounted to a conventional rowing machine, the invention is not limited to the embodiment shown and described. The invention may be mounted to a bicycle type exercise device or other type base exercise apparatus, or made self-contained.

DETAILED DESCRIPTION

Figure 1:
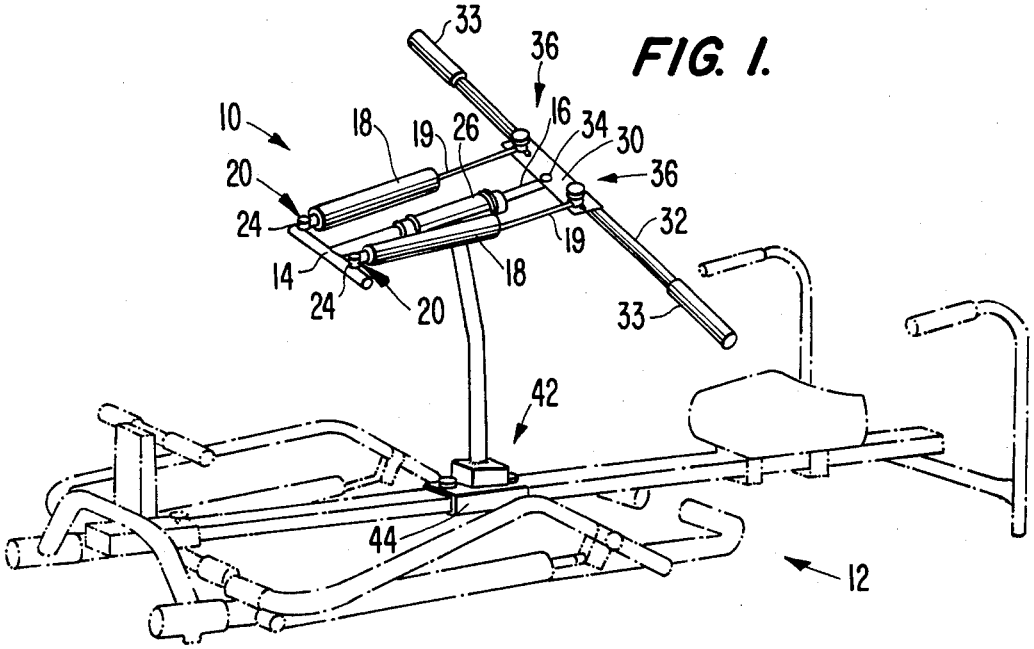
FIG. 1 is an overall perspective view of the invention mounted on a rowing machine, shown in dotted outline.

The exercise device of the present invention is shown generally at 10. As shown in FIG. 1, exercise device 10 is mounted on a rowing machine, generally designated 12. Rowing machine 12 forms no part of the present invention and is illustrated in dotted outline only for purposes of showing a preferred context in which the present invention may be used. The present invention may, of course, be mounted on other type exercise devices, such as a bicycle, or made self-contained and mounted to a stationary base.

Exercise device 10 includes a support member or frame element 14. Fixed to frame 14 is a pivot rod 16. Preferably, pivot rod 16 and frame 14 may be an integrally formed tubular structure. Resistance cylinders 18, which in a preferred form of the invention are fluid cylinders typically used in the exercise industry, are fixed to pivot pins 20 on frame number 14. It will be appreciated, of course, that other resistance means such as springs and other well known devices may also be used as resistance elements. In a conventional fashion, a cylinder bushing is inserted into an open end of a coupling on cylinder 18 and then slid over pivot pin 20. A nut or similar fastener 24 may be used to maintain cylinder 18 on pivot pin 20. Exercise apparatus 10 preferably includes a guide tube 26. Inserted within guide tube 26 are guide tube bushings (not shown) and collar members 29 which retain the bushings in place. Pivot rod 16 is inserted through guide tube 26 and securely fastened therein.

Figure 2:
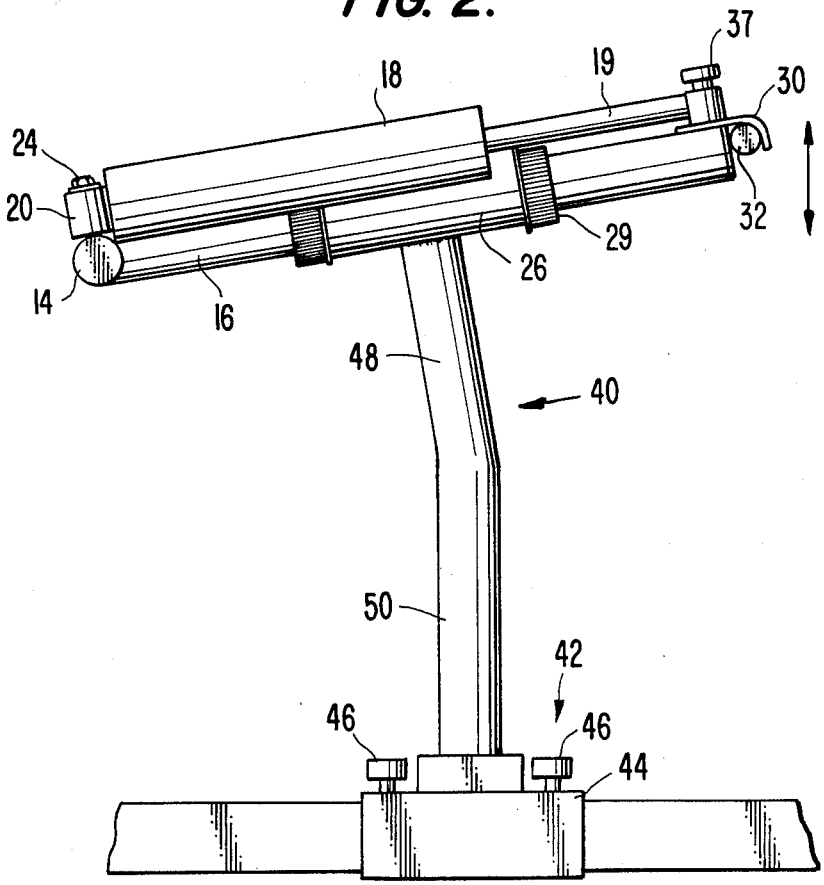
FIG. 2 is a side plan view of the present invention.
Figure 3:
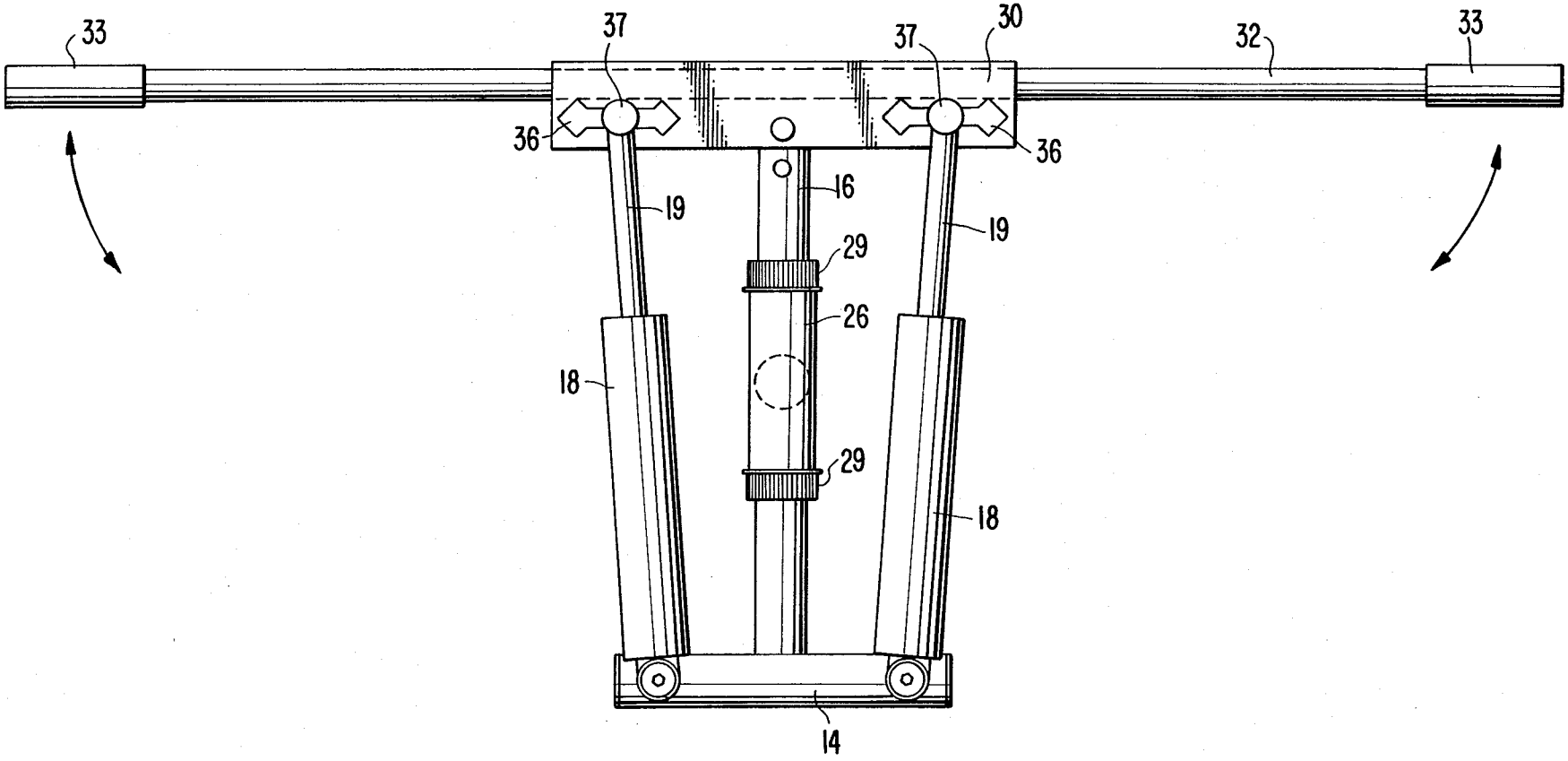
FIG. 3 is a top plan view of the present invention.

As shown, one end of cylinders 18 and pivot rod 16 is fixed to frame 14. The other end of cylinders 18 and pivot rod 16 is fixed to a mounting bracket 30 attached to a user engageable handle or oar-like rod 32 having spaced handgrips 33. Bracket 30 may preferably comprise a generally rectangular sheet member which is wrapped around or otherwise fastened to oar 32, as shown in FIG. 2. Pivot tube 16 is connected to a center opening 34 in bracket 30. A conventional pivot axle is inserted through one end of pivot rod 16 and through opening 34 in bracket 30 to pivotally connect pivot rod 16 to bracket 30. The cylinder rod ends 19 of cylinders 18 are attached to adjustment slots 36 in bracket 30 by using bolts or other conventional attaching means 37. As shown, there are at least three positions in each adjustment slot on bracket 30 in order to vary the resistance of the exercise device. The resistance can be changed by loosening screws 37 and moving the cylinder rod ends to a desired position and retightening the screws. As the cylinder rod ends are moved to the outside positions, the resistance will be increased. Conversely, as the cylinder rod ends are moved to the inside positions, the resistance will be decreased.

The invention also includes a mounting arm 40 fixed at one end to guide tube 26 and adapted to be fixed at the other end to a coupling member shown generally at 42. As shown, coupling member 42 comprises a tubular bracket 44 which is adapted to slid over a tubular bracket of complementary size and shape. In this preferred form, mounting screws 46 serve to retain the exercise device 10 firmly attached to a base. As shown in FIG. 1, the mounting arm may be fixed to a conventional rowing-type exercise device. Alternatively, the mounting arm may be fixed to any other base member or may be integrally formed with a base so that the exercise device is self-contained. Mounting arm 40 contains a guide tube portion 48 adjacent to guide tube 26 and a base portion 50 adjacent to the base to which the exercise device may be attached. Guide tube portion 48 is slightly angled away from oar 32, as shown clearly in FIG. 2, so that oar 32 is positioned slightly above frame 14. This angle permits the user to perform a single oar rowing exercises in a more natural manner when the exercise device is connected to a base member.

Although a preferred embodiment has been described, the invention is not intended to be limited thereto. Various changes and modifications may be made without departing from the scope of the invention which is defined by the following claims.

I claim:

1. An exercise device for performing rowing-type excercises comprising:

a support member;

a user-engageable handle spaced from said support member;

a pivot rod fixed at one end thereof to said support member and at the other end thereof to said handle;

a guide tube fixed about said pivot rod, said pivot rod longitudinally slidable within said guide tube;

resistance means for providing exercise resistance pivotally fixed at one end thereof to said support member and pivotally fixed at the other end thereof to a coupling bracket fixed to said handle, said resistance means positioned on each side of said pivot rod, said coupling bracket having coupling openings for selectively coupling said resistance means to one of a plurality of longitudinally spaced positions on said bracket to thereby vary the exercise resistance provided by said cylinders; and a mounting arm fixed at one end thereof to said guide tube and adapted to be fixed at the other end thereof to a base member, said mounting arm comprising a guide tube portion adjacent said guide tube and a base portion, and wherein said guide tube portion is angled with respect to said base portion, so that said user-engageable handle is fixed in position above said support member thereby permitting said user-engageable handle to move inwardly and downwardly thus more accurately simulating a single oar rowing type exercise.

2. An exercise device comprising:

a base exercise apparatus;

a support member;

a user-engageable handle spaced from said support member;

a pivot rod fixed at one end thereof to said support member and at the other end thereof to said handle;

a guide tube fixed about said pivot rod, said pivot rod longitudinally slidable within said guide tube;

resistance means for providing exercise resistance pivotally fixed at one end thereof to said support member and pivotally fixed at the other end thereof to a coupling bracket fixed to said handle, said resistance means positioned on each side of said pivot rod, said coupling bracket having coupling openings for selectively coupling said resistance means to one of a plurality of longitudinally spaced positions on said bracket to thereby vary the exercise resistance provided by said cylinders; and a mounting arm fixed at one end thereof to said guide tube and adapted to be fixed at the other end thereof to said base exercise apparatus, said mounting arm comprising a guide tube portion adjacent said guide tube and a base portion, and wherein said guide tube portion is angled with respect to said base portion, so that said user-engageable handle is fixed in position above said support member thereby permitting said user-engageable handle to move inwardly and downwardly thus more accurately simulating a single oar rowing type exercise.

3. An exercise apparatus comprising:

a base member;

a support member;

a user-engageable handle spaced from said support member;

a pivot rod fixed at one end thereof to said support member and at the other end thereof to said handle;

a guide tube fixed about said pivot rod, said pivot rod longitudinally slidable within said guide tube;

resistance means for providing exercise resistance pivotally fixed at one end thereof to said support member and pivotally fixed at the other end thereof to a coupling bracket fixed to said handle, said resistance means positioned on each side of said pivot rod, said coupling bracket having coupling openings for selectively coupling said resistance means to one of a plurality of longitudinally spaced positions on said bracket to thereby vary the exercise resistance provided by said cylinders; and a mounting arm fixed at one end thereof to said guide tube and adapted to be fixed at the other end thereof to said base member, said mounting arm comprising a guide tube portion adjacent said guide tube and a base portion, and wherein said guide tube portion is angled with respect to said base portion, so that said user-engageable handle is fixed in position above said support member thereby permitting said user-engageable handle to move inwardly and downwardly thus more accurately simulating a single oar rowing type exercise.

* * * * *